US006119063A

United States Patent [19]

Hieb et al.

[11] Patent Number: 6,119,063

[45] Date of Patent: Sep. 12, 2000

[54] SYSTEM AND METHOD FOR SMOOTH TRANSITIONS BETWEEN ENGINE MODE CONTROLLERS

[75] Inventors: Bradley John Hieb, Dearborn; Jerry Dean Robichaux, Riverview; Tobias John Pallett, Ypsilanti, all of Mich.

[73] Assignee: Ford Global Technologies, Inc., Dearborn, Mich.

[21] Appl. No.: 09/307,449

[22] Filed: May 10, 1999

[51] Int. Cl.[7] ..... F02D 41/16

[52] U.S. Cl. ..... 701/110; 123/339.14; 123/350

[58] Field of Search ..... 701/110, 93; 123/339.14, 123/339.19, 350, 396; 180/170, 178, 179

[56] References Cited

U.S. PATENT DOCUMENTS

| | | | |
|---|---|---|---|
| 4,353,272 | 10/1982 | Schneider et al. . | |
| 4,509,478 | 4/1985 | Ament et al. | 123/339.21 |
| 4,697,561 | 10/1987 | Citron . | |
| 4,730,708 | 3/1988 | Hamano et al. . | |
| 4,739,483 | 4/1988 | Ina et al. . | |
| 4,819,596 | 4/1989 | Yasuoka et al. . | |
| 4,951,627 | 8/1990 | Watanabe et al. . | |
| 5,044,457 | 9/1991 | Aikman | 180/178 |
| 5,069,181 | 12/1991 | Togai et al. . | |
| 5,078,109 | 1/1992 | Yoshida et al. . | |
| 5,086,668 | 2/1992 | Fujiwara et al. . | |
| 5,109,732 | 5/1992 | Takizawa . | |
| 5,245,966 | 9/1993 | Zhang et al. . | |

(List continued on next page.)

FOREIGN PATENT DOCUMENTS

| | | |
|---|---|---|
| 66831/81 | 9/1982 | Australia . |
| 0 206 091 B1 | 12/1986 | European Pat. Off. . |
| 0 340 764 | 11/1989 | European Pat. Off. . |
| 0 408 767 B1 | 1/1991 | European Pat. Off. . |
| 0 413 031 B1 | 2/1991 | European Pat. Off. . |
| 0 557 299 B1 | 10/1991 | European Pat. Off. . |
| 0 749 524 B1 | 2/1995 | European Pat. Off. . |
| 0 754 888 A2 | 1/1997 | European Pat. Off. . |
| 2 154 763 | 9/1985 | United Kingdom . |
| 2 239 500 | 7/1991 | United Kingdom . |
| 2 239 683 | 7/1991 | United Kingdom . |
| 2 312 970 | 11/1997 | United Kingdom . |
| WO 95/01502 | 1/1995 | WIPO . |

OTHER PUBLICATIONS

"Hierarchial Control Strategy Of Powertrain Functions", by H.M. Streib et al, 24. FISITA Congress, London Jun. 7–11, 1992, pp. 1–11.

"Torque–Based System Structure of the Electronic Engine Management System (ME7) as a New Base for Drive Train Systems", by J. Gerhardt et al, 6. Aachener Kolloquim Fahrzeug– und Motorentechnik '97, Oct. 22, 1997, pp. 817–849.

*Primary Examiner*—Andrew M. Dolinar
*Attorney, Agent, or Firm*—Allan J. Lippa; Roger L. May

[57] ABSTRACT

A system and method for controlling an internal combustion engine using a controller to implement at least two control modes having corresponding first and second mode controllers with disparate control parameters include comparing output of the first and second mode controllers to generate an error, generating a correction value based on the error, and providing the correction value to one of the mode controllers to provide a smooth transition of control between the mode controllers. In one embodiment, the first controller is a torque controller which determines a desired air flow to achieve a desired torque and the second mode controller is an idle speed controller which determines a desired air flow to maintain a desired engine speed. The invention is advantageous in that it provides for smooth transitions between control modes, such as between idle mode and a normal driving mode, by harmonizing the outputs of the controllers. Drivability is improved by eliminating an aggressive and/or sluggish response to accelerator pedal position when transitioning between idle speed control and normal driving modes.

20 Claims, 4 Drawing Sheets

U.S. PATENT DOCUMENTS 5,304,102 4/1994 Narita et al. .
5,325,740 7/1994 Zhang et al. .
5,351,776 10/1994 Keller et al. .
5,374,224 12/1994 Huffmaster et al. .
5,398,544 3/1995 Lipinski et al. .
5,407,401 4/1995 Bullmer et al. .
5,408,966 4/1995 Lipinski et al. .
5,408,974 4/1995 Lipinski et al. .
5,431,139 7/1995 Grutter et al. .
5,437,253 8/1995 Huffmaster et al. .
5,445,125 8/1995 Allen .
5,462,501 10/1995 Bullmer et al. .
5,484,351 1/1996 Zhang et al. .
5,501,644 3/1996 Zhang .
5,503,129 4/1996 Robichaux et al. .
5,520,159 5/1996 Pao et al. .
5,568,795 10/1996 Robichaux et al. .
5,575,257 11/1996 Lange et al. .
5,588,178 12/1996 Liu .
5,603,672 2/1997 Zhang .
5,605,131 2/1997 Ohno et al. .
5,606,951 3/1997 Southern et al. .
5,628,706 5/1997 Zhang et al. .
5,646,851 7/1997 O'Connell et al. ..... 701/93
5,680,763 10/1997 Unland et al. .
5,692,471 12/1997 Zhang .
5,743,083 4/1998 Schnaibel et al. .
5,901,682 5/1999 McGee et al. ..... 123/339.19
5,983,861 11/1999 Nishio et al. ..... 123/350

SYSTEM AND METHOD FOR SMOOTH TRANSITIONS BETWEEN ENGINE MODE CONTROLLERS

TECHNICAL FIELD

The present invention relates to a system and method for providing smooth transitions between control strategies for internal combustion engines.

BACKGROUND ART

Control strategies for internal combustion engines have evolved from purely electromechanical strategies to increasingly more complex electronic or computer controlled strategies. Spark-ignited internal combustion engines have traditionally used air flow as the primary control parameter, controlled by a mechanical linkage between a throttle valve and an accelerator pedal. Fuel quantity and ignition timing, originally mechanically controlled, were migrated to electronic control to improve fuel economy, emissions, and overall engine performance. Electronic throttle control systems have been developed to further improve the authority of the engine controller resulting in even better engine performance.

Electronic throttle control replaces the traditional mechanical linkage between the accelerator pedal and the throttle valve with an "electronic" linkage through the engine or powertrain controller. Because of this electrical or electronic linkage, this type of strategy is often referred to as a "drive by wire" system. A sensor is used to determine the position of the accelerator pedal which is input to the controller. The controller determines the required air flow and sends a signal to a servo motor which controls the opening of the throttle valve. Control strategies which imitate the mechanical throttle system by controlling the opening of the throttle valve based primarily on the position of the accelerator pedal position are often referred to as pedal follower systems. However, the ability of the controller to adjust the throttle valve position independently of the accelerator pedal position offers a number of potential advantages in terms of emissions, fuel economy, and overall performance.

An engine control strategy typically has a number of operating modes, such as idle, cruise control, engine speed limiting, vehicle speed limiting, dashpot, normal driving, etc. The various control modes may or may not use the same or similar primary control parameters. Furthermore, modes of operation often use different control strategies, which may include open-loop and/or closed loop feedback/feedforward control strategies. Likewise, different strategies may utilize proportional, integral, and/or derivative control with control parameters tuned to particular applications or operating conditions.

To provide optimal driving comfort and robust control of the engine under varying conditions, it is desirable to provide smooth transitions between control modes. In particular, it is desirable to provide smooth or seamless transitions between idle control mode, where the accelerator pedal is not depressed, and a normal driving mode where the accelerator pedal is depressed.

SUMMARY OF INVENTION

It is an object of the present invention to provide a system and method for transitioning between control modes of an internal combustion engine by harmonizing control values generated by each controller.

A further object of the present invention is to provide a system and method for smoothly transitioning between an air flow-based idle speed control mode and a torque-based control driving mode for an internal combustion engine.

In carrying out the above objects and other objects, features, and advantages of the present invention, a system and method for controlling an internal combustion engine using a controller to implement at least two control modes having corresponding first and second mode controllers with disparate control parameters include comparing output of the first and second mode controllers to generate an error, generating a correction value based on the error, and providing the correction value to one of the mode controllers to provide a smooth transition of control between the mode controllers. In one embodiment, the first controller is a torque controller which determines a desired air flow to achieve a desired torque and the second mode controller is an idle speed controller which determines a desired air flow to maintain a desired engine speed.

The invention is advantageous in that it provides for smooth transitions between control modes, such as between idle mode and a normal driving mode, by harmonizing the outputs of the controllers. Drivability is improved by eliminating an aggressive and/or sluggish response to accelerator pedal position when the transitioning to and from idle control mode.

The above advantages and other advantages, objects, and features of the present invention, will be readily apparent from the following detailed description of the best mode for carrying out the invention when taken in connection with the accompanying drawings.

BEST MODE(S) FOR CARRYING OUT THE INVENTION

Figure 1:
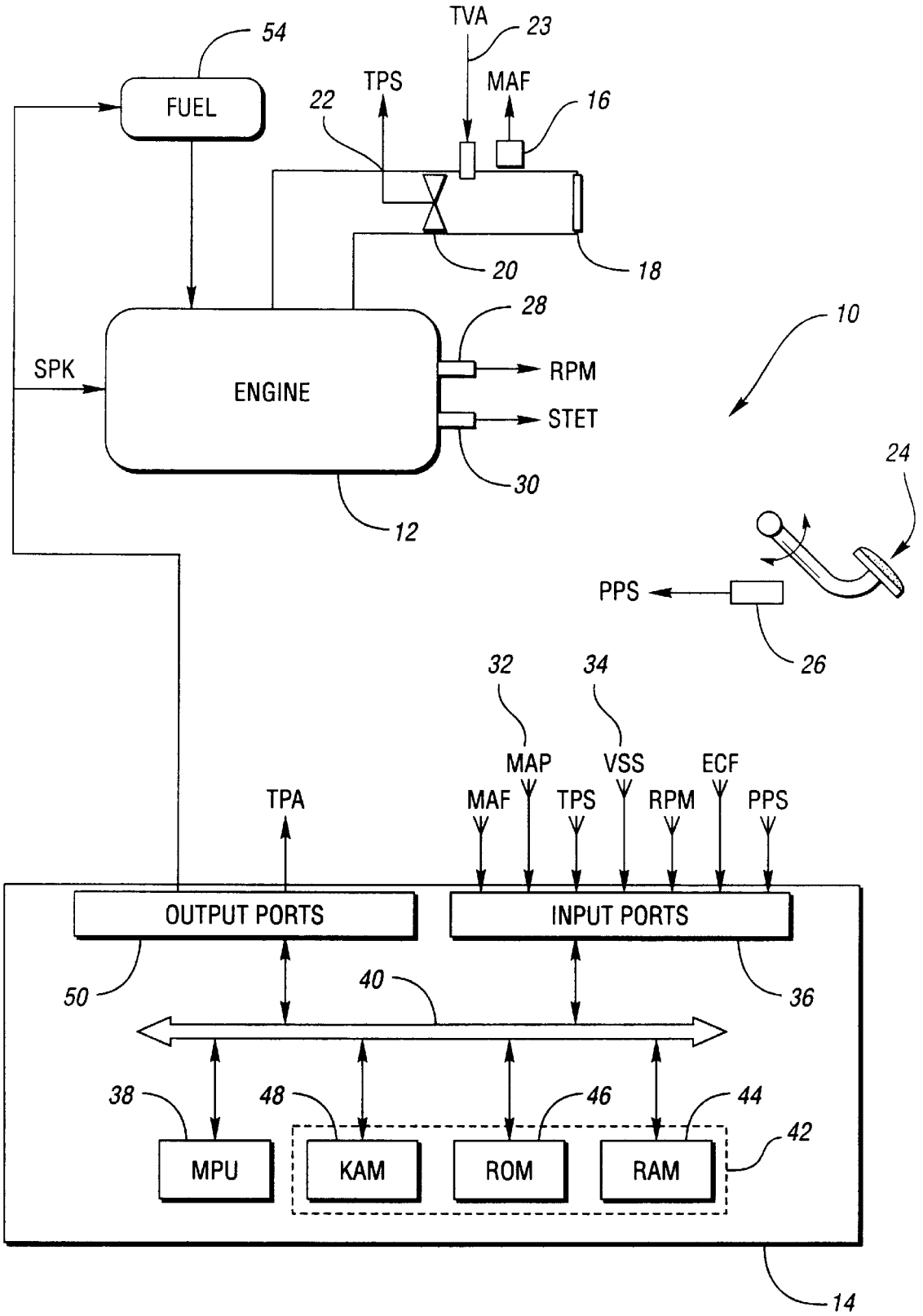
FIG. 1 is a block diagram illustrating a system and method for engine control which provides smooth transitions according to the present invention.

FIG. 1 provides a block diagram illustrating operation of a system or method for providing smooth transitions between mode controllers according to the present invention. System 10 includes an internal combustion engine, indicated generally by reference numeral 12, in communication with a controller 14. Various sensors are provided to monitor engine operating conditions. Sensors may include a mass air flow sensor (MAF) 16 which monitors the air passing through intake 18. A throttle valve 20 regulates the air intake into engine 12 as well known in the art. A throttle position sensor (TPS) 22 provides an appropriate signal to controller 14 to monitor the throttle angle or position of throttle valve 20. An appropriate actuator such as a mechanical or electronic accelerator pedal 24 is used to determine the driver demand which, in turn, is used in the control of the position of throttle valve 20.

In a preferred embodiment, system 10 is an electronic throttle control system which uses a pedal position sensor (PPS) 26 to provide a signal indicative of the position of an accelerator pedal 24. Controller 14 uses the pedal position sensor signal, along with various other signals indicative of current engine operating conditions, to control the position of throttle valve 20 via an appropriate servo motor or other actuator 23. Such electronic throttle control or "drive-by-wire" systems are well known in the art.

Engine 12 may include various other sensors such as an engine speed sensor (RPM) 28, an engine temperature or coolant temperature sensor (TMP) 30, a manifold absolute pressure (MAP) sensor 32, a vehicle speed sensor (VSS) 34, and the like.

Processor 14 receives signals from the various sensors via input ports 36 which may provide signal conditioning, conversion, and/or fault detection, as well known in the art. Input port 36 communicates with processor 38 via a data/control bus 40. Processor 38 implements control logic in the form of hardware and/or software instructions which may be stored in computer-readable media 42 to effect control of engine 12. Computer-readable media 42 may include various types of volatile and nonvolatile memory such as random-access memory (RAM) 44, read-only memory (ROM) 46, and keep-alive memory (KAM) 48. These "functional" classifications of memory may be implemented by one or more different physical devices such as PROMs, EPROMs, EEPROMs, flash memory, and the like, depending upon the particular application.

In a preferred embodiment, processor 38 executes instructions stored in computer-readable media 42 to carry out a method for controlling engine 12 using at least two mode controllers implemented in software and/or hardware to communicate with various actuators of engine 12 via output port 50. Actuators may control ignition timing or spark (SPK) 52, timing and metering of fuel 54, or position of throttle valve 20 to control air flow. Electronic control of air flow may also be performed using variable cam timing, for example. Preferably, controller 14 is used to implement at least two mode controllers which provide idle speed control and torque-based engine control depending upon the particular mode of operation of engine 12.

Figure 2:
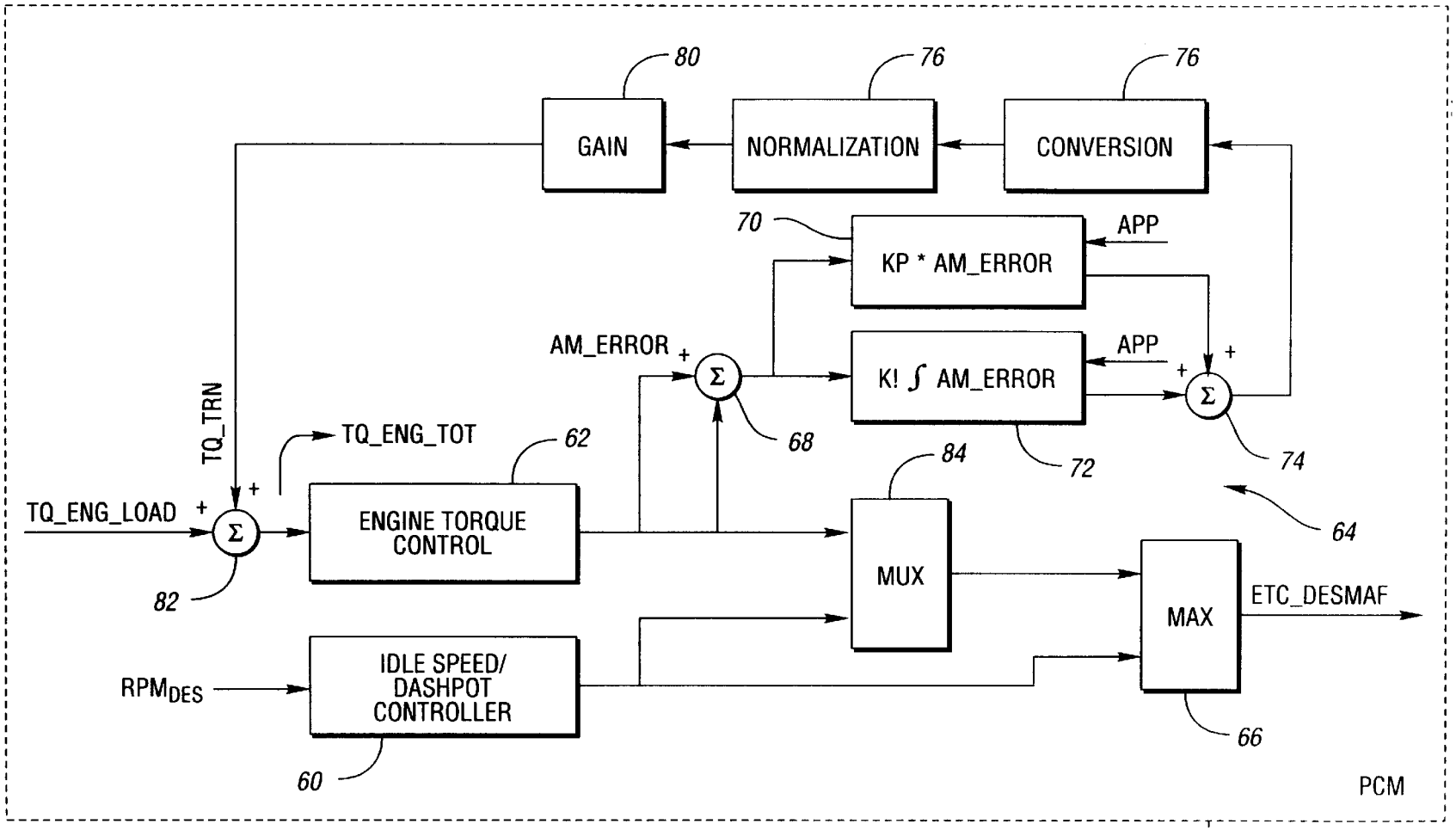
FIG. 2 is a block diagram illustrating idle speed and engine torque controllers according to the present invention.

FIG. 2 is a block diagram illustrating representative mode controllers for idle speed control and engine torque control according to the present invention. Idle speed controller 60 and engine torque controller, indicated generally by reference numeral 62, are preferably implemented within a powertrain control module or controller 14. However, the present invention is generally applicable to any control system having disparate mode controllers where control passes between mode controllers during operation. For example, the present invention could also be applied to a throttle angle/throttle follower based control system architecture where interpreted driver demand corresponds to a throttle valve position or angle. The present invention provides a trim value or correction value to the input of a first controller based on the difference in outputs of the first and second controllers to provide a smooth transition between controllers. Preferably, the correction value is generated by a third feedback controller 64 which is selectively activated to drive the difference or error between outputs of the first and second controllers toward zero.

In the embodiment illustrated in FIG. 2, idle speed controller 60 generates a desired air flow (DESMAF) based on a desired engine speed (RPMDES). Likewise, engine torque controller 62 generates a desired air flow (TQ_DESMAF) based on a desired total engine torque (TQ_ENG_TOT). The outputs from idle speed controller 60 and torque controller 62 are switched or multiplexed based on the accelerator pedal position as represented by block 84. A status indicator (APP) indicates whether the accelerator pedal is fully released, partly depressed, or fully depressed. Idle speed controller 60 is activated or active when the APP flag indicates that the throttle pedal is fully released. Otherwise, engine torque controller 62 is active. Block 66 selects the larger value of the output from block 64 and idle speed controller 60. The resulting air flow is converted to a desired throttle position and used to control the 5 throttle valve.

In one embodiment, idle speed controller 60 also includes a dashpot control mode to control the rate of engine deceleration whenever engine speed is significantly above the idle speed and the accelerator pedal is fully released.

The desired air flow outputs from idle speed controller 60 and engine torque controller 62 are compared at block 68 to generate an error signal. In this embodiment, controller 64 is a proportional-integral (PI) controller which updates its output only when the APP status flag indicates that the accelerator pedal is not being depressed. Of course, any kind of feedback controller could be substituted for the PI controller shown in FIG. 2. Preferably, the controller drives the control output continuously to provide a zero steady state error and quickly responds to changes in the error signal without objectionable oscillation or overshoot. The output of the proportional block 70 and integral block 72 is combined at block 74. This control output is then converted from units of air flow to a unitless load at block 76. In a preferred embodiment, this is accomplished by dividing by the number of cylinders per minute (engine speed times cylinders divided by 2), and then dividing by the standard temperature air charge per cylinder, which depends on the per cylinder displacement of the engine. The result from block 76 is multiplied by a load-to-engine torque normalizer at block 78 to convert the unitless quantity to a torque. The output of block 78 is multiplied by a final gain at block 80 to provide the necessary correction value based on the air mass error. Of course, the gain provided by block 80 could be incorporated into controller 64 or block 78, but is provided for ease of calibration and tuning. The resulting correction value from block 80 is combined with the engine torque request (TQ_ENG_LOAD) at block 82.

Figure 3A:
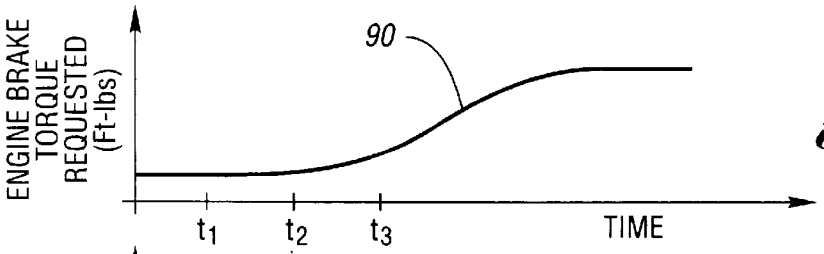
FIGS. 3*a* and 3*b* are graphs depicting an aggressive or jumpy transition between controllers without the benefit of the present invention.
Figure 3B:
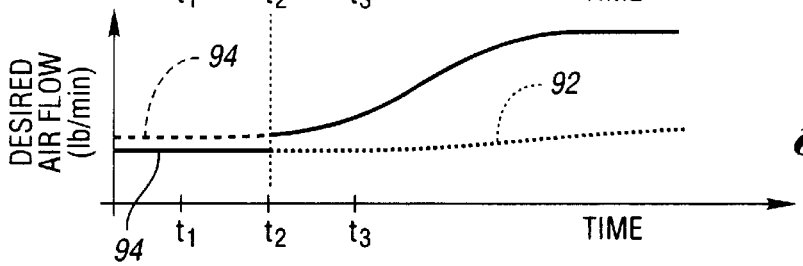

FIGS. 3*a* and 3*b* provide a graphical representation of a jittery transition between mode controllers without the benefit of the present invention. FIG. 3*a* represents the requested engine torque 90 as a function of time. FIG. 3*b* represents the requested or desired air flow from the idle speed controller 92, the engine torque controller 94, and the resulting final torque 96 based on the active controller. At time $t_1$, the accelerator pedal is fully released and the idle speed controller is active. As illustrated in FIG. 3*b*, the driver demanded air flow 94 is greater than the idle speed control air flow 92 which is collinear with the final air flow 96. The accelerator pedal begins to be depressed at tine $t_2$. The active controller transitions from the idle speed controller to the engine torque controller resulting in jitter of the final commanded air flow 96.

Figure 4A:
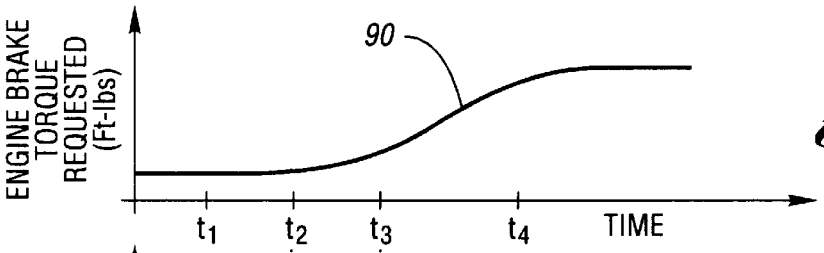
FIGS. 4*a* and 4*b* are graphs depicting a sluggish or "dead pedal" transition between controllers without the benefit of the present invention.
Figure 4B:
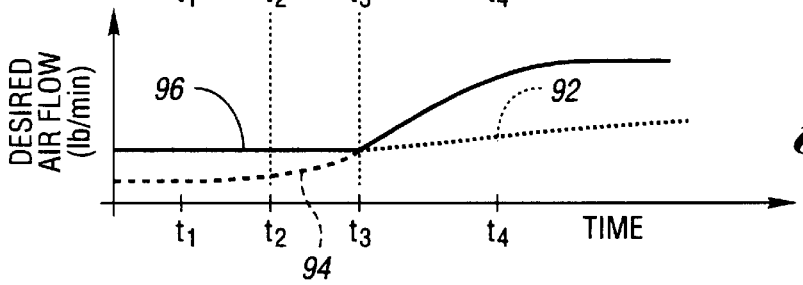

FIGS. 4*a* and 4*b* are graphs illustrating a sluggish or "dead pedal" transition between mode controllers without the benefit of the present invention. As illustrated in FIG. 4*b*, the air flow requested from the idle speed controller 92 exceeds the driver demanded air flow 94 at time $t_1$ when the idle speed controller is active. At time $t_2$, the accelerator pedal is depressed and the engine torque controller becomes the active controller. However, the air flow requested from the idle speed controller exceeds that of the engine torque controller, and therefore controls the final commanded air flow 96. As a result, the final commanded air flow remains at the same level and there is no increase in the resulting engine torque even though the accelerator pedal is being depressed. The final commanded air flow does not begin to actually increase until the accelerator pedal is depressed to a point represented as time $t_3$ resulting in a "dead pedal" feel, i.e. no increase in engine torque in response to an increase in the accelerator pedal position.

Figure 5A:
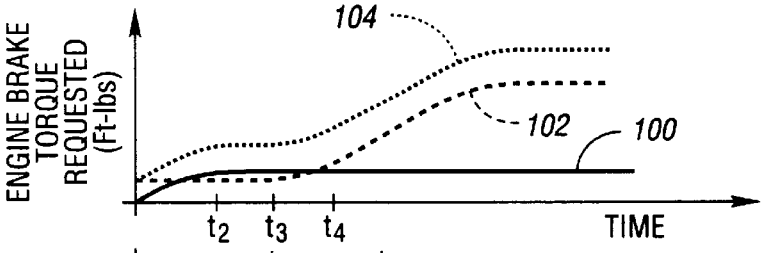
FIGS. 5*a* and 5*b* are graphs depicting a responsive smooth transition between controllers according to the present invention.
Figure 5B:
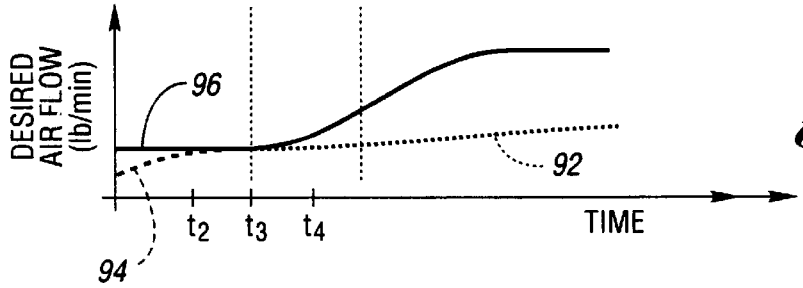

FIGS. 5*a* and 5*b* provide graphs illustrating a smooth transition between mode controllers according to the present invention. FIG. 5*a* illustrates operation of the correction value according to the present invention. The correction value, represented generally by line 100, is added to the input to the engine torque controller, represented by line 102. The resulting requested torque is represented by line 104. Unlike the examples illustrated in FIGS. 3 and 4, the total requested torque shows a smooth transition when the final commanded air flow transitions from the idle speed controller to the engine torque controller. As represented in FIG. 5*b*, air flow requested by the idle speed controller, represented by line 92, exceeds the air flow requested by the engine torque controller, represented by line 94, prior to time $t_2$. During this time, the correction value feedback controller generates a correction value 100 which is added to the input of the engine torque controller to increase the requested air flow 94. As a result, the air flows requested by the idle speed controller and the engine torque controller are approximately equal at time $t_2$. As such, when the accelerator pedal is depressed at time $t_3$, a smooth, seamless transition between mode controllers results.

In a preferred embodiment, the correction value is preferably added to the input of the engine torque controller. In addition to providing a filtering effect, this technique provides a correction that represents an actual torque. This is advantageous in that the engine torque controller assumes that the requested torque is the total engine load for the purpose of calibration of various other control parameters including spark, EGR, and pumping losses which will result. If the idle air flow were simply added to the engine torque requested air flow, the resulting load would be higher than expected by the torque-to-load calculation, resulting in unsatisfactory performance. Providing the correction value to the input of the engine torque controller provides a more robust control of engine torque and smooth transitions between the idle/dashpot controller and the engine torque controller.

Figure 6:
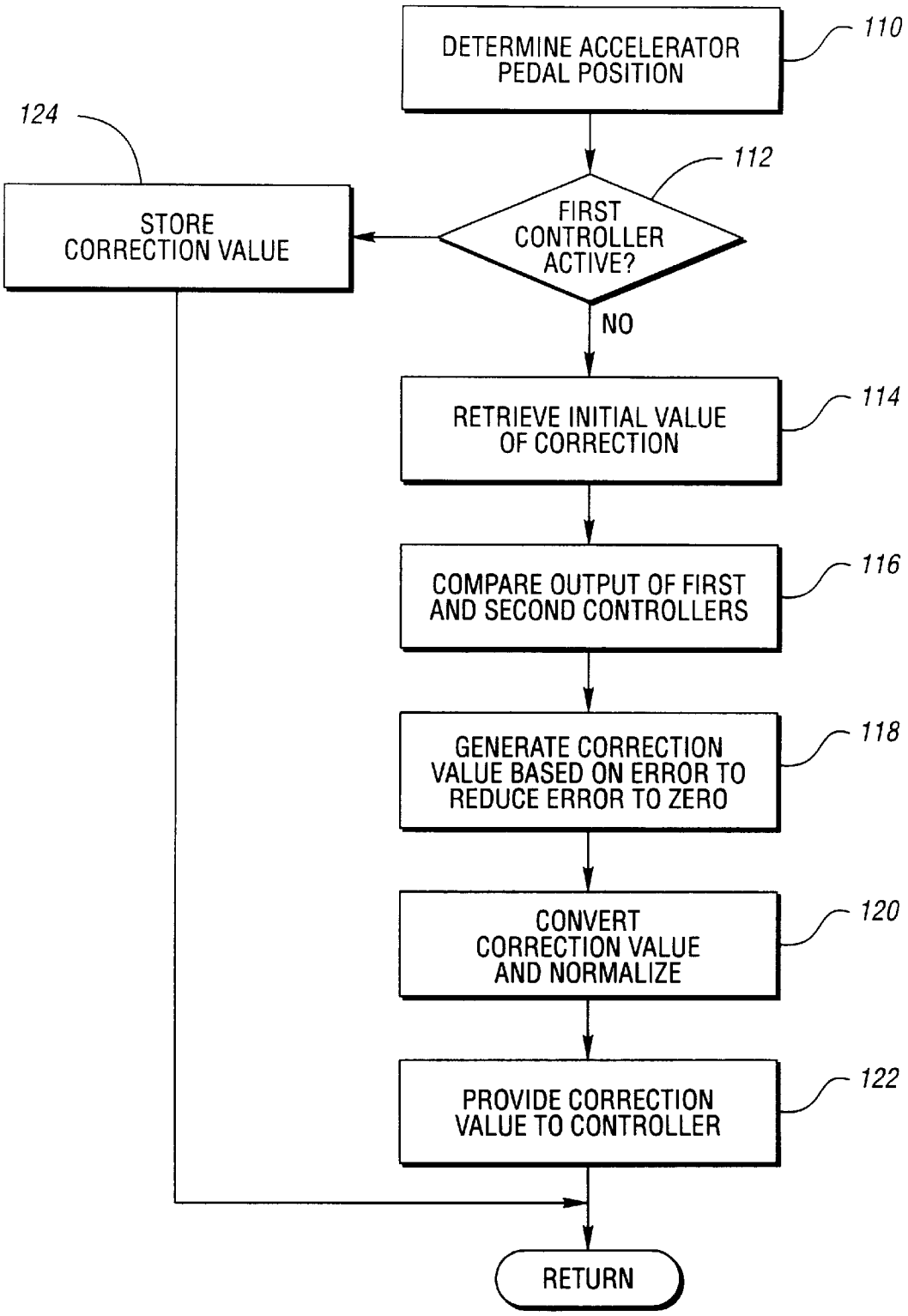
FIG. 6 is a flowchart illustrating control logic for providing smooth transitions between mode controllers in a system or method according to the present invention.

Referring now to FIG. 6, a flowchart illustrating control logic for providing smooth transitions between mode controllers in a system or method according to the present invention is shown. One of ordinary skill in the art will recognize that the control logic may be implemented in software, hardware, or a combination of software and hardware. Likewise, various processing strategies may be utilized without departing from the spirit or scope of the present invention. For example, most real-time control strategies utilize event-driven or interrupt-driven processing. As such, the sequence of operations illustrated is not necessarily required to accomplish the advantages of the present invention, and is provided for ease of illustration only. Likewise, various steps may be performed in parallel or by dedicated electric or electronic circuits.

Block 110 represents determination of the accelerator pedal position for an electronic throttle control application. The accelerator pedal position may be used by block 112 to determine which controller is active. Of course, various other inputs may also be utilized to determine the active mode controller, such as the status of the cruise control or various other engine operating parameters. When the first controller is active as determined by block 112, an initial value for the correction term is retrieved from storage as indicated by block 114. The outputs from the first and second controllers are compared to generate an error signal as represented by block 116. The error signal is used to generate a correction value which is preferably feedback-controlled to reduce the error toward zero as represented by block 118. The correction value is converted to the proper parameters or units as indicated by block 120. The correction value may also be normalized, if desired, as described in greater detail above. In a preferred embodiment, block 120 converts an air flow error to a correction value in units of torque. The correction value is then provided to one of the controllers as represented by block 122.

If the first controller is not active as indicated by block 112, then the previously generated correction value, if any, is stored for future retrieval as represented by block 124. This step is performed in a preferred embodiment to prevent excessive integrator wind-up in the PI feedback controller. Depending upon the particular feedback controller, if any, this step may not be necessary.

While the best mode for carrying out the invention has been described in detail, those familiar with the art to which this invention relates will recognize various alternative designs and embodiments for practicing the invention as defined by the following claims.

What is claimed is:

1. A method for controlling an internal combustion engine using a controller to implement at least two control modes having corresponding first and second mode controllers with disparate control parameters, wherein either the first or the second controller is selectively activated to control output of the engine, the method comprising:

comparing output of the first and second mode controllers to generate an error;

generating a correction value based on the error; and providing the correction value to one of the mode controllers to provide a smooth transition of control between the mode controllers.

2. The method of claim 1 further comprising:

determining which mode controller has been activated to control output of the engine;

performing the steps of comparing, generating, and providing only when the second controller has been activated.

3. The method of claim 2 wherein the step of determining comprises determining which mode controller has been activated based on position of an accelerator pedal.

4. The method of claim 2 wherein the step of determining comprises determining which mode controller has been activated based on status of a cruise control indicator.

5. The method of claim 2 further comprising:

storing the correction value when control transitions from the second mode controller to the first mode controller; and retrieving a previously stored correction value when control transitions from the first mode controller to the second mode controller active.

6. The method of claim 1 wherein the first mode controller determines a desired air flow based on a desired torque, the second mode controller determines a desired air flow based on a desired engine speed, and wherein the step of generating a correction value comprises:

generating a correction value based on an air flow error value; and converting the correction value to a torque value which is provided as an input to the first mode controller.

7. The method of claim 1 wherein the first mode controller determines a desired air flow based on an accelerator pedal position, the second mode controller determines a desired air flow based on a desired engine speed, and wherein the step of generating a correction value comprises:

generating a correction value based on an air flow error value; and converting the correction value to an accelerator pedal position value which is provided to the first mode controller.

8. The method of claim 7 wherein the step of converting the correction value comprises providing the correction value to the input of the first mode controller.

9. The method of claim 7 wherein the first mode controller determines a desired air flow based on an accelerator pedal position and at least one additional operating parameter.

10. The method of claim 7 wherein the at least one additional operating parameter includes engine speed.

11. The method of claim 1 wherein the step of generating a correction value comprises generating a correction value which reduces the error value toward zero.

12. The method of claim 1 wherein the first mode controller determines a desired throttle valve position based on an accelerator pedal position, the second mode controller determines a desired throttle valve position based on a desired air flow, and wherein the step of generating a correction value comprises:

generating a correction value based on a throttle valve position error; and converting the correction value to an accelerator pedal position value which is provided as an input to the first mode controller.

13. A method for controlling an internal combustion engine using a controller to implement at least an idle speed controller based on a first control parameter and a driving controller based on a second control parameter, the first and second control parameters representing different engine control parameters, the method comprising:

comparing output of the idle speed controller to output of the driving controller to generate an error value;

generating a correction value based on the error value when the idle speed controller is active; and providing the correction value to the driving controller such that output of the driving controller is approximately equal to output of the idle speed controller when the idle speed controller is active to provide smooth transitions between the idle speed controller and the driving controller.

14. The method of claim 13 wherein the step of generating a correction value comprises:

generating a correction value only when the idle speed controller is active;

storing the correction value when the driving controller becomes active; and retrieving a previously stored correction value when the idle controller becomes active prior to generating subsequent correction values.

15. The method of claim 13 further comprising:

comparing output of the idle speed controller to output of the driving controller to determine which is larger; and selecting the larger output to control the engine.

16. The method of claim 13 wherein the idle speed controller generates a desired amount of air based on a desired engine speed, wherein the driving controller generates a desired amount of air based on a desired torque, and wherein the step of generating a correction value comprises converting an air flow error to a corresponding torque value.

17. A computer readable storage device having stored therein data representing instructions executable by a computer to control an internal combustion engine having an idle speed controller and a driving controller and selectively activating one of the idle speed and driving controllers based on position of an accelerator pedal, the computer readable storage device comprising:

instructions for comparing output of the idle speed controller to output of the driving controller to generate an error value;

instructions for generating a correction value based on the error value when the idle speed controller is active; and instructions for providing the correction value to the driving controller such that output of the driving controller is approximately equal to output of the idle speed controller when the idle speed controller is active to provide smooth transitions between the idle speed controller and the driving controller.

18. The computer readable storage medium of claim 17 wherein the instructions for generating a correction value comprise:

instructions for generating a correction value only when the idle speed controller is active;

instructions for storing the correction value when the driving controller becomes active; and instructions for retrieving a previously stored correction value when the idle controller becomes active prior to generating subsequent correction values.

19. The computer readable storage medium of claim 17 further comprising:

instructions for comparing output of the idle speed controller to output of the driving controller to determine which is larger; and instructions for selecting the larger output to control the engine.

20. The computer readable storage medium of claim 17 wherein the instructions for generating a correction value comprise instructions for converting an air flow error to a corresponding torque value.

* * * * *